United States Patent [19]

Dodd et al.

[11] Patent Number: 4,896,077

[45] Date of Patent: Jan. 23, 1990

[54] IGNITOR DISABLER

[75] Inventors: Peter G. Dodd, Scarborough; Lister Young, Weston, both of Canada

[73] Assignee: Cooper Industries, Inc., Houston, Tex.

[21] Appl. No.: 363,425

[22] Filed: Jun. 5, 1989

Related U.S. Application Data

[63] Continuation of Ser. No. 62,914, Jun. 16, 1987, abandoned.

[51] Int. Cl.[4] ..... H05B 41/14

[52] U.S. Cl. ..... 315/289; 315/307

[58] Field of Search ..... 315/141, 240, 242, 239, 315/276, 289, 307, 209 R

[56] References Cited

U.S. PATENT DOCUMENTS

| | | | |
|---|---|---|---|
| Re. 29,204 | 5/1977 | Snyder | 315/239 |
| 4,179,641 | 12/1979 | Britton | 315/289 |
| 4,307,353 | 12/1981 | Nilssen | 331/113 A |
| 4,438,372 | 3/1984 | Zuchtriegel | 315/244 |
| 4,513,364 | 4/1985 | Nilssen | 363/132 |
| 4,544,863 | 10/1985 | Hashimoto | 315/224 |
| 4,677,345 | 6/1987 | Nilssen | 315/209 R |
| 4,763,044 | 8/1988 | Nuckolls et al. | 315/176 |

*Primary Examiner*—Benedict V. Safourek
*Assistant Examiner*—T. Salindong
*Attorney, Agent, or Firm*—Michael F. Heim; Ravi Shukla

[57] ABSTRACT

An ignitor disabler for disabling an ignitor in a high intensity discharge lamp monitors the operating or characteristic voltage of the lamp. When the characteristic voltage of the lamp exceeds an AC threshold established by the disabler, the ignitor disabler disables the ignitor to prevent spurious pulses. In this manner, the ignitor is effectively disabled during periods when the lamp is operating abnormally. The ignitor disabler includes a timing network which is reset only when an excessive voltage is detected. The reset portion of the disabler includes a field effect transistor for discharging the timing network.

21 Claims, 2 Drawing Sheets

IGNITOR DISABLER

This is a continuation of co-pending application Ser. No. 07/062,914 filed on June 16, 1987, now abandoned.

BACKGROUND OF THE INVENTION

1. Field of the Invention

This invention relates to ignitor disablers, and more particularly, to ignitor disablers which are suitable for disabling ignitors employed in igniting and operating circuits for high intensity discharge lamps, particularly of the high pressure sodium type.

2. Background of the Prior Art

High intensity discharge (HID) lamps are used in many applications because of their long life and high efficiency for converting electrical energy to light. The principal types of HID lamps are mercury vapor, metal halide and high pressure sodium (HPS).

Mercury, metal halide and HPS lamps all operate similarily during stabilized lamp operation. The visible light output results from the ionization of gases confined within an envelope and which must be broken down before there is any flow of ionization current. For this reason, a high open circuit voltage must be applied to a HID lamp for igniting and this voltage is substantially higher than the operating voltage and the available line voltage.

Another characteristic of HID lamps is that they exhibit negative resistance. That is, when operating their resistance decreases with the applied voltage. As a result, such devices require an impedance means in their power supply circuit for limiting the current flow to a predetermined value.

Because of the high starting or igniting voltage requirement and the negative resistance characteristic, HID lamps are provided with igniting and operating circuits which provide a relatively high open circuit voltage, a lower operating voltage and impedance means for current limitation. A ballast between the power supply and the lamp typically serves as the impedance means in igniting and operating circuits for HID lamps. For some HID lamps, such as mercury vapor lamps, igniting voltages are on the order of two times the operating voltage. The igniting voltage is generated by the ballast acting in conjunction with a capacitor. For other types of HID lamps, such as HPS lamps, wherein the required igniting voltages are typically more than ten times the operating voltages, more complex igniting mechanisms are required. Examples of starting or igniting circuits for such lamps are disclosed in U.S. Pat. No. 4,322,660 to Johnson and U.S. Pat. No. 4,683,404 to Hitchcock. The Johnson patent discloses an apparatus for providing high voltage pulses for starting a HPS discharge lamp, said apparatus having a single capacitor in series with a blocking diode and a charging resistor. When the voltage of the capacitor reaches a predetermined voltage exceeding the zener voltage of a parallel zener diode, the capacitor discharges through a ballast which is connected in autotransformer relationship therewith to provide the high voltage pulse to start the lamp. Hitchcock discloses an apparatus including two capacitors, two blocking diodes, a voltage sensitive symmetrical switch, and multiple resistances across which pulses are distributed. The aforementioned elements are electrically connected together and with a tapped ballast reactor so that one of the capacitors charges through an impedance in the negative half-cycle, and thereafter, when line voltage goes positive, the other capacitor charges through an impedance equal to the sum of the multiple resistances. When the voltage of the capacitors reaches a predetermined voltage exceeding the breakdown voltage of the voltage sensitive symmetrical switch, the capacitors discharge. This discharge, because of an autotransformer relationship within the reactor, produces a high voltage pulse of predetermined height and width once per each cycle of the source voltage.

Notwithstanding the many similarities noted above between the various types of HID lamps, there are, however, unique requirements for HPS lamps which the ballast system typically provides. As discussed in the preceding paragraph, some type of electronic ignitor is used in conjunction with the HPS ballast coils to produce a high voltage pulse to start the HPS lamp. In all cases, these electronic ignitors work on the principle of sensing whether or not the lamp is burning, and if not, the ignitor continuously supplies starting pulses to the lamp. Electronic ignitors are generally insensitive to reasons why the lamp is not burning, and, accordingly, function in the same manner regardless whether nonburning of lamp is caused by lamp failure, by absence of lamp in the lamp socket, or by lamp "cycling" off. Lamp cycling is a well known phenomenon in which a lamp nearing the end of its life will light, burn for some time, go out, relight and repeat this cycle time after time, until the lamp is either replaced or will fail to start at all. This phenomenon is caused because of a characteristic life trend of lamp operating voltage in HPS lamps. As a HPS lamp nears the end of its life, its lamp operating voltage gradually increases. The normal end of such a lamp is when its lamp operating voltage gets so high that the ballast will no longer sustain operation. This condition usually manifests itself as an above-described "cycling" lamp. Further information about this phenomenon is set forth in an article entitled "Recommendations for Lamp Maintenance in High Pressure Sodium Luminaires" in Main-Lighter—Official Publication of the InterNATIONAL ASSOCIATION OF LIGHTING MAINTENANCE CONTRACTORS, Volume 10, Number 7, page 1 (December 1982).

From the foregoing, it should be clear that there are a number of shortcomings in the prior art. In certain cases, e.g., when a lamp is cycling, failed or missing, ignitors in HID circuits continue to operate. Such futile operation shortens ignitor life, particularly in cases where the ignitor operates in conjunction with the ballast so that more than excitation power is drawn by the transformer, that is, to be more specific, where the ballast coil is stressed as a consequence of the ignitor operation. Cycling lamps can also cause problems by possibly avoiding easy detection of impending failure. A lamp may be "cycling on" when inspected and, hence, escape replacement. In situations where obtaining access to lamps is difficult and inspections are not frequent, such as when the lamps are used for roadway lighting, failure to detect a cyling lamp will inevitably lead to futile ignitor operation and consequent deterioration.

SUMMARY OF THE INVENTION

To overcome the above-described shortcomings in the prior art, and to provide other advantages and new features described in greater detail below, the present invention, either incorporated into or designed for retrofit into an igniting and operating circuit for a lamp, includes means for disabling the ignitor for the lamp, means for triggering said means for disabling the ignitor after passage of a predetermined amount of time, said means for triggering having a timing component for measuring the predetermined amount of time, which timing component begins time measuring operation only under certain predetermined conditions; and means for resetting the timing component of said means for triggering upon lamp ignition.

Accordingly, one object of the present invention is to disable ignitors for HPS lamps under fault or no lamp conditions.

Another object of the present invention is to increase the effective lives of ignitors and ballasts in HPS lamp igniting and operating circuits by preventing lamp cycling and unnecessary high voltage insulation breakdown.

Yet another object of the present invention is to give a lamp user a clear indication of end of lamp life.

Still yet another object of the present invention is to provide a unit that is substantially independent of the ballast and can therefore be used in conjunction with any standard ballast/ignitor currently commercially available for conventional HPS lamps.

A further object of the present invention is to provide an ignitor disabler unit that can be retrofitted to any existing installation at minimum cost, since the ballast does not have to be changed to accommodate the function.

Other objects, advantages, and new features of the invention will become apparent from the following detailed description of the invention when considered in conjunction with the accompanying drawings wherein:

DETAILED DESCRIPTION OF THE INVENTION

Figure 1:
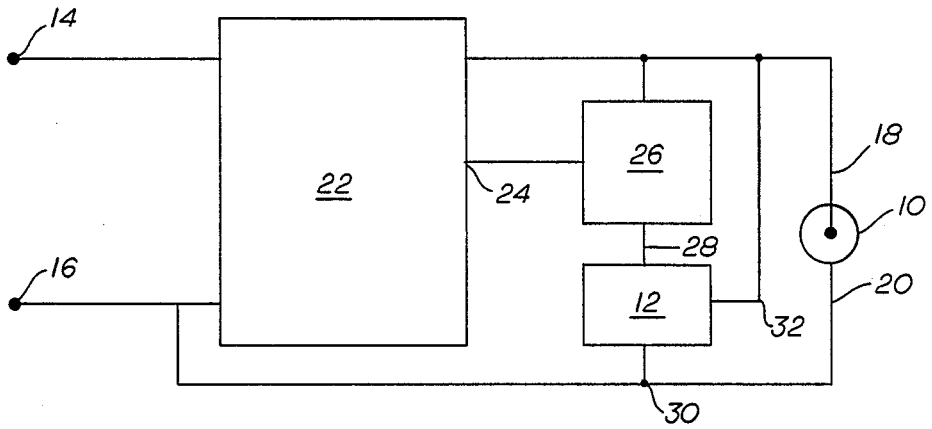
FIG. 1 is a block diagram of a igniting and operating circuit for a HPS lamp, said circuit including therein an ignitor disabler according to the present invention.

In FIG. 1 is shown a schematic diagram of a circuit for connection across an AC source for igniting and operating a HPS lamp 10. The circuit includes an ignitor disabler 12 according to the present invention. The circuit comprises input terminals 14, 16 operable to be connected across the AC source and output terminals 18, 20 operable to have the lamp 10 connected across.

A convention ballast reactor 22 has a tap 24 intermediate the ends thereof which defines first and second winding portions, said first winding portion generally having a greater length than said second winding portion, and having a transformation ratio therebetween substantially greater than unity. The ballast reactor 22 is connected at its ends between input terminal 14 and output terminal 18, with the second winding portion connected to the output terminal 18. Input terminal 16 electrically connects the output terminal 20. Details regarding this type of structure and its function are very well known to those skilled in the art and are discussed at length in numerous references, including U.S. Pat. No. 4,107,579 to Bodine. To minimize detailed discussion herein not completely germane to the substance of the present invention, the Bodine reference and its teachings are hereby incorporated into this document by reference. Likewise those skilled in the art recognize the desirability in many cases of including a power correction capacitor (not shown) in HPS lamp circuits. As details regarding inclusion and placement of such a capacitor are well known, they are not discussed further herein.

A conventional ignitor, such as described in the prior art section above, is connected across a second winding portion of ballast 22 so as to exploit the inherent autotransformer relationship therein and thus be capable of generating a high voltage pulse to ignite lamp 10. As can be seen in FIG. 1, this connection across the second winding portion of ballast 22 is accomplished by electrically connecting ignitor 26 at some point within its system to tap 24 and at some other point within its system to output terminal 18. Whereas in conventional igniting and operating circuits for HPS lamps; and note is here made of the teachings in U.S. Pat. No. 4,683,404 which teachings are hereby incorporated by reference; the igniting apparatus also is directly in circuit with output terminal 20, in the circuit shown in FIG. 1 a new element 12, the ignitor disabler according to the present invention, is inserted between ignitor 26 and output terminal 20. As is further shown in FIG. 1, at some point the ignitor disabler system according to the present invention also connects to output terminal 18.

For clarity and convenience, at this point terminal connections to what can be considered an independent ignitor disabler system or retrofittable unit, are designated ignitor disabler terminals 28, 30, 32. Referring to FIG. 1, terminal 28 can be seen to electrically connect to some point within the ignitor 26 system, terminal 30 can be seen to electrically connect to output terminal 20, and terminal 32 can be seen to electrically connect to output terminal 18.

Figure 2:
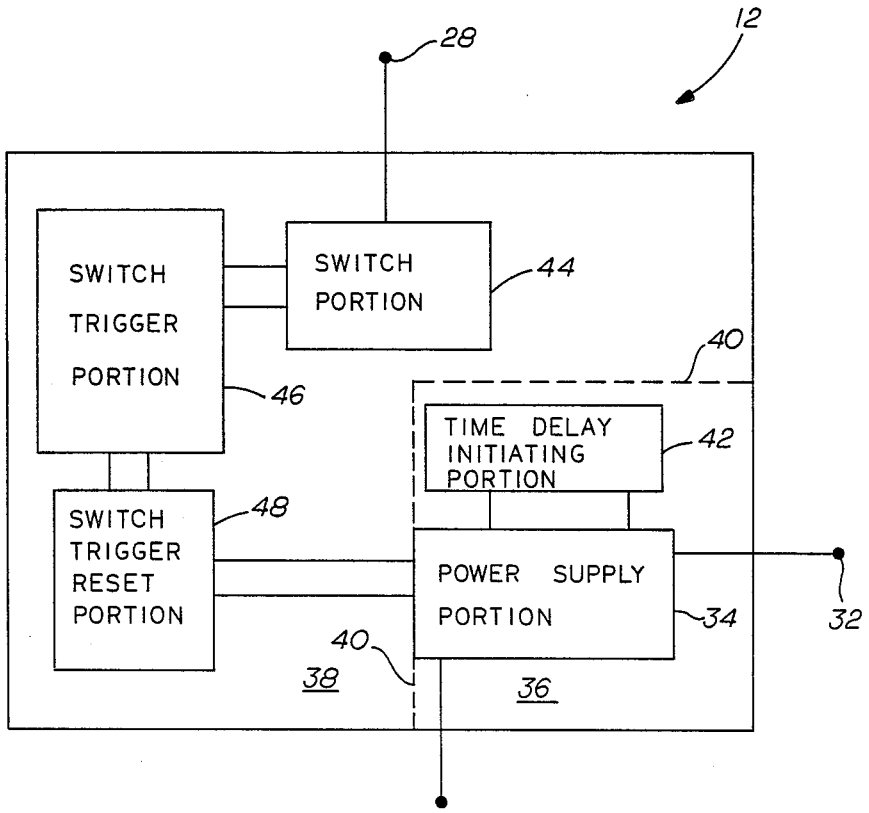
FIG. 2 is a block diagram showing subportions of an ignitor disabler according to the present invention.

Referring now to FIG. 2, the ignitor disabler 12 is shown therein in greater detail. Major subcomponents of the disabler 12 are depicted by individual blocks. Terminals 30 and 32 can be seen to electrically connect to a power supply portion 34. Power supply portion 34 is designed to convert alternating current from the ballast secondary winding to direct current. Accordingly, power supply portion 34 effectively divides disabler 12 into an AC part 36 and a DC part 38, the border between the respective parts designated by dashed line 40. It is important to note that the time delay initiating portion 42 is depicted as operating within the AC part 36 of disabler 12. The purpose and function of portion 42 and further details about this aspect of applicant's invention are discussed in greater detail below.

Terminal 28 can be seen to electrically connect to a switch portion 44. Switch portion 44 is designed to generate an ignitor disabling signal for transmission to ignitor 12 via terminal 28 under certain predetermined conditions. Switch portion 44 is connected to and triggered by a switch trigger portion 46. Under the certain predetermined conditions, portion 46 is designed to trigger portion 44, thereby transmitting an ignitor disabling signal out of the disabler via terminal 28. Under the teachings of the present invention, the certain predetermined conditions involve passage of a certain predetermined amount of time. Accordingly, switch trigger portion 46 includes a timing component for measuring time.

Switch trigger portion 46, already discussed as being connected to switch portion 44, is also connected to a switch trigger reset portion 48. Switch trigger reset portion 48 is designed to sense through various connections which ultimately lead to terminals 30 and 32, across which lamp 10 is connected, lamp 10 ignition. Once switch trigger reset portion 48 senses lamp 10 ignition, it resets trigger portion 46 by, under the teachings of the present invention, stopping and immediately resetting to zero the timing component within the switch trigger reset portion.

Referring now back to time delay initiating portion 42, mentioned only briefly above, that portion 42 is designed, in part, to perform the opposite function of switch trigger reset portion 48. Whereas switch trigger reset portion 48 stops and immediately resets to zero the timing component of switch trigger portion 46, time delay initiating portion 42 sets the timing component into operation. Once the timing component is set into operation, by means discussed immediately below, unless the reset portion subsequently senses lamp ignition and terminates time measurement, switch trigger portion 46 will trigger switch portion 44 and cause transmission of an ignitor disabling signal out of disabler 12. Two important aspects of portion 42 under the teachings of the present invention should be noted. First, portion 42 includes means for establishing a threshold voltage. As discussed in the description of a preferred embodiment below, this threshold voltage can be used as a bench mark for establishment of the certain predetermined conditions which begin the measuring of time within the switch trigger portion 46. For example, as in the preferred embodiment described below, this threshold voltage could be compared to the operating voltage of a lamp 10 and systematically connected so as to begin the time measuring if and when the lamp operating voltage exceeds the threshold voltage. It should be remembered, as discussed in the background of the prior art section above, that a HPS lamp's operating voltage rises as the lamp nears the end of its life, so that an operating voltage being greater than a threshold voltage is an effective timing trigger. A second important aspect of portion 42 is that it is designed to operate in the previously described AC part 38 of disabler 12. In conventional practice, threshold voltages are set in the DC parts of circuits. There are a number of advantages in establishing a threshold in the AC part of a circuit including less complexity of construction. These advantages, and the awareness that this is an exceedingly novel feature of applicants invention, should become clear to those skilled in the art upon examination of the example of the preferred embodiment described immediately below.

Figure 3:
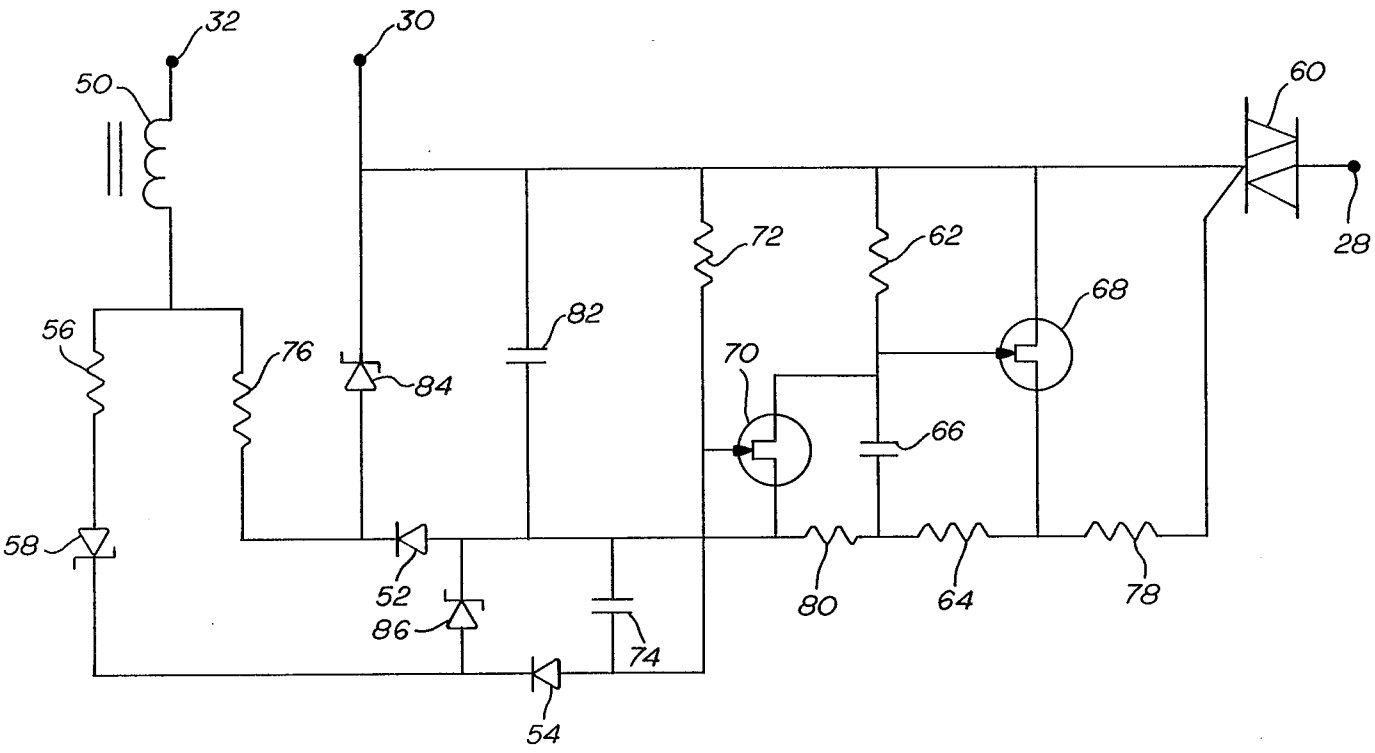
FIG. 3 is a circuit diagram of a preferred embodiment of an ignitor disabler according to the present invention, which embodiment is especially suitable for use in conjunction with conventional high pressure sodium lamps up to a 150 watt maximum.

Referring now to FIG. 3, shown therein is a circuit diagram for preferred embodiment of the ignitor disabler of the present invention. The topography is basically the same as in FIG. 2 except for including some circuit details for practical application. Terminals 32, 30, 28 correspond to the identically numbered terminals in FIGS. 1 and 2.

The power supply portion of the circuit of FIG. 3 comprises choke 50 and rectifying diodes 52, 54. Of course, it should be readily apparent to those skilled in the art that alternating current applied across terminals 32, 30 will be converted to direct current by operation of diodes 52, 54.

The time delay initiating portion, which, as mentioned above, performs an AC threshold function, comprises dropping resistor 56 and zener diode 58.

The switch portion of disabler 12 comprises a bidirectional triode thyristor or triac 60. Triac 60 is inserted between terminal 28 and switch trigger portion 46. In FIG. 3, the switch trigger portion comprises resistor 62, 64, capacitor 66 and field effect transistor (FET) 68. Those skilled in the art will appreciate that the above-identified components constitute a conventional RC timing network which operates in conjunction with FET 68 to apply a "trigger" current to the gate of triac 60. In preferred embodiments of the present invention, of which the embodiment of FIG. 3 is an example, built in time delay will be sufficient to accommodate momentary interruption of power resulting in lamp outage. As is well known to those skilled in the art, lamp and fixture combinations, after operating for some time and being extinguished, must cool down to a certain degree before the lamp is capable of being reignited. In such hot restrike circumstances, if sufficient time is not allowed for the ignitor to be in the on mode during the cool down period, the high voltage pulses will cease before the lamp is capable of reignition resulting in lack of lamp restrike. The various elements of the circuit depicted in FIG. 3 are of such values and are so operatively connected to provide sufficient time for hot restrike of lamps.

A second FET, designated FET 70, a resistor 72 and a capacitor 74 combine to form the switch trigger reset portion of the disabler. As those skilled in the art will readily appreciate, the discharge of timing capacitor 66 is performed by FET 70. As has been previously mentioned, in all previous circuits serving the purpose of the circuit of the present invention, a bipolar transistor has been used to discharge timing capacitors. This practice has left a voltage residue of approximately 0.6 volts in capacitor 66. The use of FET 70 in the circuit of the present invention insures that timing capacitor 66 discharges to zero volts at all temperatures. A second aspect of the above-described trigger reset portion that those skilled in the art will readily appreciate is that it is electrically incorporated into the circuit shown in FIG. 3 so that FET 70 resets or discharges timing capacitor 66 upon sensing of lamp 10 ignition accomplished based upon voltage drop across lamp 10 connected across terminals 30 and 32.

Various other circuit components, specifically, resistors 76, 78, 80, capacitor 82 and zener diodes 84, 86 are incorporated into the circuit of the preferred embodiment of the present invention as position clearly set forth in FIG. 3 where they perform current resisting, filtering and voltage limiting functions in well known manners fully understood and appreciated by those skilled in the art.

By way of example only, a circuit such as shown in FIG. 3 could be constructed of components having designations or values as listed below.

| Element Number | Type of Element | Designation or Value |
|---|---|---|
| 50 | Inductor | 25 mH |
| 52 | Diode | 1N4001 |
| 54 | Diode | 1N4001 |
| 56 | Resistor | 150K |
| 58 | Zener Diode | 75 V, 1N5374 |
| 60 | Triac | T2300B |
| 62 | Resistor | 1 MEG |

-continued

| Element Number | Type of Element | Designation or Value |
|---|---|---|
| 64 | Resistor | 1.2K |
| 66 | Capacitor | 220 uf, 10 V |
| 68 | FET | 2N5640 |
| 70 | FET | 2N3640 |
| 72 | Resistor | 470K |
| 74 | Capacitor | 0.1 uf |
| 76 | Resistor | 5.6K, 5 W |
| 78 | Resistor | 220 |
| 80 | Resistor | 220 |
| 82 | Capacitor | 220 uf, 10 V |
| 84 | Zener Diode | 6.8 V, 1N5342 |
| 86 | Zener Diode | 19 V, 1N5356 |

From the foregoing description and identification of circuit components, those skilled in the art will readily appreciate and understand operation of the presently preferred embodiment of the present invention. Lamp 10 voltage passes through choke 50 which filters the high voltage starting pulses from the 120 V.A.C. present at that point. Resistor 76, placed in series with choke 50, performs a voltage dropping and current limiting function for the negative 6 V.D.C. supply. Zener diode 84, connected from the end of resistor 76 to common, limits the voltage and produces a square wave output peaked at negative 6.8 volts. This square wave is cause to flow through a rectifer diode 52 insuring that only negative voltage is present on filter capacitor 82 which is connected from the anode of diode 52 to common.

The timing circuit components are resistor 62 in series with capacitor 66 connected from the common to the negative 6 volt power supply line. The common point of the RC timing network is connected to the gate of FET 68 with the drain and supply connections of FET 68 going to the common and negative 6 volt power supply lines. When power is first applied to the circuit the gate of FET 68 is held low and FET 68 is turned off. As capacitor 66 charges, through current flow from resistor 62, FET 68 gate voltage increases until FET 68 turns on, and prevents current from flowing into the gate terminal of triac 60.

Triac 60 controls the AC power to the ignitor 26. Triac 60 exercises such control because it is in series with the common and starter connection point 28 as depicted in FIG. 1. On initial power up current flows into the gate of triac 60 via resistors 76, 64 and 78 which limit the current. As the timing circuit comes into effect and FET 68 turns on, the triac 60 gate current ceases to flow and triac 60 turns off preventing starter 26 from functioning.

The reset function is performed by FET 70. A negative 25 V.D.C. supply, for the reset function, is generated by dropping the voltage and limiting the current, through the resistor 56 and the series zener diode 58. The diode 58 also determines a threshold voltage under which the reset is performed. The voltage is squared by the zener diode 86 connected from the cathode of zener diode 58 to the anode of diode 52, and then rectified and smoothed by the diode 54 and capacitor 74. This negative 25 V.D.C. is connected to the gate of FET 70 and controls the discharge of timing capacitor 66. When the negative 25 V.D.C. is not present, which it would not be when the lamp is operating, resistor 72, connected from the gate of FET 70 to the common, pulls the gate of FET 70 high, turning the FET 70 on and discharging or resetting capacitor 66. When the negative 25 V.D.C. is present, as it would be if the lamp voltage is high or if the lamp is bad or if there is no lamp, the gate of FET 70 is pulled low turning it off and allowing capacitor 66 to charge up and perform predetermined time delay, energizing starter 26.

At this point, practical operation of the ignitor disabler should be readily apparent to those skilled in the art. For example, when incorporated into or retrofitted into a igniting and operating circuit for an HPS lamp and a cold start (lamp) is undertaken, the ignitor disabler will have no effect and the lamp will start and operate normally. Under a cold start (unlamped) condition with the ignitor disabler in the circuit the high voltage pulses will cease after the predetermined interval. If a lamp is screwed into a receptacle of a fixture under these conditions, the lamp will not ignite and it will be necessary to reset the disabler. Reset under these conditions would entail turning the power off and on again which will lead to the lamp igniting and functioning normally. If a short power interruption were to occur, a circuit having the disabler will extinguish the lamp, and a cool down period of 30 to 60 seconds will occur before the lamp reignited. This is identical to operation of circuits without a disabler installed, as the disabler resets itself automatically. If the lamp shall be faulty or if a lamp parameters go beyond the capability of the ballast output, as in the case of a cycling "end of life" lamp, the disabler will disable the ignitor and, hence, increase its useful life. In a regular system, on the other hand, the ignitor will continue to supply high voltage and reduce the ignitor's operational life. It may be noted that in the case of the cycling "end of life" lamp, switching the power off and on again resets the disabler and the lamp will reignited and run for a cycle.

With regard to method of fabrication of a circuit according to the present invention, a printed circuit board containing the circuitry as shown in FIG. 3 and potted in a can approximately $2\frac{1}{4}$ inches times $1\frac{1}{2}$ inches times $2\frac{1}{4}$ inches oval, with three leads protruding outside the can for connecting purposes can be constructed by conventional techniques. Further, the can be insulated by a polyolefin heat shrink tube to prevent shorting to surrounding circuitry, also a conventional technique. An alternative construction would be to cast the circuit board in a potting compound without a separate metal can.

A unique aspect of the ignitor disabler of the present invention is its independence from the ballast. Because of this independence, it can be used in conjunction with any standard ballast/ignitor currently commercially available with appropriate adjustment of element values within the disabler. The preferred embodiment of FIG. 3 can itself be used on any primary voltage from 120 volts to 600 volts without modification since it derives its power from the ballast secondary winding which in all cases involving lamps of 150 watts or lower is providing the 120 volt open circuit voltage dictated by the arc tube voltage requirement of such lamps. Further, in all potential embodiments of the disabler of the present invention, because each is a separate unit, each can be retrofitted to any existing installation at minimum cost, since the ballast does not have to be changed to accommodate the function.

Obvious, numerous modifications and variations of the present invention are possible in light of the above teachings. For example, in the presently preferred embodiment switch trigger portion 46 includes an FET 68. This component 68 could be eliminated in future preferred embodiments of the present invention. Other changes may be made by circuits to work with higher wattage HPS lamps. It is therefore two claims, the present invention may be practiced otherwise in a specifically described hereinabove.

We claim:

1. In a circuit for igniting a high intensity discharge lamp, with a characteristic voltage that varies during phases of lamp operation, said circuit including portion, an ignitor disabler comprising:

means for disabling the igniting portion during abnormal lamp operation;

means for triggering said means for disabling the igniting portion after passage of a predetermined amount of time, said means for triggering having a timing component for measuring the predetermined amount of time, which timing component begins time measuring operation only under certain, predetermined conditions;

means for resetting the timing component of said means for triggering upon lamp ignition; and means for establishing a threshold voltage which threshold voltage is higher than the characteristic voltage of the lamp under normal operating conditions.

2. The invention as defined in claim 1 wherein said lamp is a high pressure sodium lamp and the certain predetermined conditions under which the timing component begins time measuring operations including all conditions in which the characteristic voltage of the lamp exceeds the threshold voltage.

3. The invention as defined in claim 2 wherein the ignitor disabler further comprises:

means for receiving AC power; and a power supply portion which converts alternating current to direct current in which effectively divides the disabler into an AC part and a DC part.

4. The invention as defined in claim 3 wherein the means of disabler.

5. The invention as defined in claim 1 wherein the timing component comprises:

a timing capacitor; and a field effect transistor for performing discharge of the timing capacitor;

whereby capacitor discharge to an effective zero volt level is assured.

6. An apparatus for connection across an AC source for disabling an ignitor for a high intensity discharge lamp, said lamp having a characteristic voltage that varies during the life of the lamp, said apparatus comprising:

input terminals operable to be connected across said AC source and said lamp;

means for establishing a threshold voltage, which threshold voltage is higher than the characteristic voltage of the lamp under normal operating conditions;

means for producing an ignitor disabling signal under certain predetermined condition, wherein one of the predetermined conditions is when the characteristic voltage of the lamp exceeds the threshold voltage; and output means operable to be coupled to said ignitor through which said ignitor disabling signal can be transmitted to said ignitor.

7. The apparatus of claim 6 wherein said means for producing an ignitor disabling signal under certain predetermined conditions, which conditions are substantially independent of temperature, further comprises:

switching means;

triggering means for said switching means;

means for measuring time from condition of presence of power within the apparatus and failure of lamp to ignite;

means for automatically resetting said triggering means on condition of lamp ignition; and means for causing operation of said triggering means after passage of a predetermined amount of time in the absence of automatic reset of said triggering means.

8. The apparatus of claim 7 further comprising means for sensing presence of power within the apparatus and failure of the lamp to ignite.

9. The apparatus of claim 8 wherein said sensing presence of power within the apparatus and failure of the lamp to ignite comprises AC voltage threshold establishing means.

10. The apparatus of claim 9 wherein said triggering means for said switching means comprises a field effect transistor.

11. A circuit for a high intensity discharge lamp with a characteristic voltage that varies during the life of the lamp, comprising:

an ignitor connected to the lamp for igniting the lamp when the lamp is turned-off;

an ignitor disabler connected to said ignitor and to the lamp;

said ignitor disabler including detecting means for detecting abnormal operation of the lamp and means for generating a disabling signal;

said detecting means connected to said generating means and said generating means connected to said ignitor; wherein said detecting means monitors the characteristic voltage of said lamp, and said generating means generates a disabling signal when said detecting means detects a voltage in excess of a predetermined maximum characteristic voltage for the lamp; and said ignitor disabler disables said ignitor when said detecting means detects abnormal lamp operation by having said generating means transmit the disabling signal to said ignitor.

12. A circuit according to claim 11, wherein the abnormal operation of the lamp is the absence of a lamp.

13. A circuit according to claim 11, wherein the abnormal operation of the lamp is the failure of the lamp.

14. A circuit according to claim 11, wherein the abnormal operation of the lamp is the cycling of the lamp.

15. A circuit according to claim 11, wherein said detecting means detects the AC voltage of the lamp.

16. A circuit according to claim 11, wherein said generating means includes; a means for triggering the disabling signal and a means for resetting the triggering means; said resetting means connected to said detecting means and said triggering means connected to said resetting means.

17. A circuit according to claim 16, wherein said triggering means includes a timing means.

18. A circuit according to claim 17, wherein said resetting means includes a field effect transmitter for resetting the timing means.

19. A circuit according to claim 16, wherein the resetting means resets said triggering means when said resetting means receives a signal from said detecting means.

20. A circuit according to claim 19, wherein said detecting means only outputs a signal to said resetting means when the lamp is operating normally.

21. A circuit according to claim 19, wherein said detecting means does not output a signal to said resetting means when said detecting means detects abnormal operation of the lamp.

* * * * *

UNITED STATES PATENT AND TRADEMARK OFFICE

CERTIFICATE OF CORRECTION

PATENT NO. : 4,896,077

DATED : January 23, 1990

INVENTOR(S) : Peter G. Dodd and Lister Young

It is certified that error appears in the above—identified patent and that said Letters Patent is hereby corrected as shown below:

Column 8, line 39, after "can" (first occurrence) insert --,-- and after "purposes" insert --,--.

Column 9, line 2, after "therefore", delete --two--.

Column 9, line 2, after "therefore", insert --to be understood that within the scope of the appended--.

Column 9, line 3, after "otherwise", delete --in a--.

Column 9, line 3, after "otherwise", insert --than as--.

UNITED STATES PATENT AND TRADEMARK OFFICE

CERTIFICATE OF CORRECTION

PATENT NO. : 4,896,077

DATED : January 23, 1990

INVENTOR(S) : Peter G. Dodd, et al

It is certified that error appears in the above-identified patent and that said Letters Patent is hereby corrected as shown below:

Col. 9, line 8, claim 1, after "including", insert --an igniting--.

Col. 9, line 34, claim 3, after "current", delete --in--.

Col. 9, line 37, claim 4, after "means", insert--for establishing a threshold voltage operates in the AC part--, and after "of", insert --the--.

Col. 9, line 56, claim 6, change "condition" to --conditions--.

Signed and Sealed this

Twenty-fourth Day of September, 1991

*Attest:*

HARRY F. MANBECK, JR.

*Attesting Officer*

*Commissioner of Patents and Trademarks*